US007014520B2

(12) United States Patent
Johnson

(10) Patent No.: US 7,014,520 B2
(45) Date of Patent: Mar. 21, 2006

(54) INTERNAL BODY ENCIRCLING BELT FOR PERSONAL FLOATATION DEVICES

(75) Inventor: Jean Ellen Johnson, South Haven, MN (US)

(73) Assignee: Steams, Inc., Sauk Rapids, MN (US)

( * ) Notice: Subject to any disclaimer, the term of this patent is extended or adjusted under 35 U.S.C. 154(b) by 0 days.

(21) Appl. No.: 10/714,512

(22) Filed: Nov. 14, 2003

(65) Prior Publication Data

US 2005/0106962 A1 May 19, 2005

(51) Int. Cl.
*B63C 9/08* (2006.01)

(52) U.S. Cl. ..... 441/112; 441/116

(58) Field of Classification Search ..... 441/108, 441/112, 113, 116, 117, 119
See application file for complete search history.

(56) References Cited

U.S. PATENT DOCUMENTS

| | | | | |
|---|---|---|---|---|
| 1,313,936 A | | 8/1919 | Bailey | |
| 1,366,347 A | | 1/1921 | Bailey | |
| 2,363,639 A | * | 11/1944 | Brown | 441/112 |
| RE25,601 E | * | 6/1964 | Baker | 441/108 |
| 3,449,778 A | * | 6/1969 | Jones | 441/112 |
| 3,736,610 A | | 6/1973 | Frieder, Jr. | |
| 4,694,772 A | | 9/1987 | Faulconer et al. | |
| 4,799,908 A | | 1/1989 | Lucius | |
| 5,022,879 A | * | 6/1991 | DiForte | 441/113 |
| 5,549,495 A | | 8/1996 | Burnworth et al. | |
| 6,235,661 B1 | * | 5/2001 | Khanamirian | 442/223 |
| 2003/0124925 A1 | * | 7/2003 | Steger et al. | 441/117 |

* cited by examiner

*Primary Examiner*—Stephen Avila
(74) *Attorney, Agent, or Firm*—Black Lowe & Graham PLLC; Darren J. Jones

(57) ABSTRACT

The present invention comprises a system for a buoyant material, a cover, and a belt arranged between the cover and the buoyant material. The belt is stitched to the cover at at least one location. In accordance with further aspects of the invention, the belt is stitched to the cover near a first lateral edge and a second lateral edge. In accordance with other aspects of the invention, the belt passes through the cover and is stitched to the cover near the location where the belt passes through the cover.

49 Claims, 4 Drawing Sheets

INTERNAL BODY ENCIRCLING BELT FOR PERSONAL FLOATATION DEVICES

FIELD OF THE INVENTION

This invention relates generally to personal floatation devices and more specifically, to personal floatation device fabrication.

BACKGROUND OF THE INVENTION

Personal Floatation Devices (PFDs) commonly incorporate buoyant foam material. Current Coast Guard requirements require body encircling belts holding the floatation material to the user's body, when the PFD is used as a ski vest. Such belts or body straps are commonly arranged outside of the floatation material, exposing the body strap to snagging, also affecting ease of function and aesthetics.

Therefore, there exists an unmet need in the art for an improved interface between body straps and floatation materials in personal floatation devices.

SUMMARY OF THE INVENTION

The present invention comprises a system for use in a personal flotation device including a buoyant material, a cover, and a belt arranged between the cover and the buoyant material. The belt is stitched to the cover at at least one location. In accordance with further aspects of the invention, the belt is stitched to the cover near a first lateral edge and a second lateral edge. In accordance with other aspects of the invention, the belt passes through the cover and is stitched to the cover near the location where the belt passes through the cover.

BRIEF DESCRIPTION OF THE DRAWINGS

The preferred and alternative embodiments of the present invention are described in detail below with reference to the following drawings.

DETAILED DESCRIPTION OF THE INVENTION

The present invention generally relates to personal floatation devices with covers and body straps, and methods for constructing such devices. Many specific details of certain embodiments of the invention are set forth in the following description and in FIGS. 1–4 to provide a thorough understanding of such embodiments. One skilled in the art, however, will understand that the present invention may have additional embodiments, or that the present invention may be practiced without several of the details described in the following description.

By way of background, the present invention comprises a system for a buoyant material, a cover, and a belt arranged between the cover and the buoyant material. The belt is stitched to the cover at at least one location. In accordance with further aspects of the invention, the belt is stitched to the cover near a first lateral edge and a second lateral edge. In accordance with other aspects of the invention, the belt passes through the cover and is stitched to the cover near the location where the belt passes through the cover.

Figure 1:
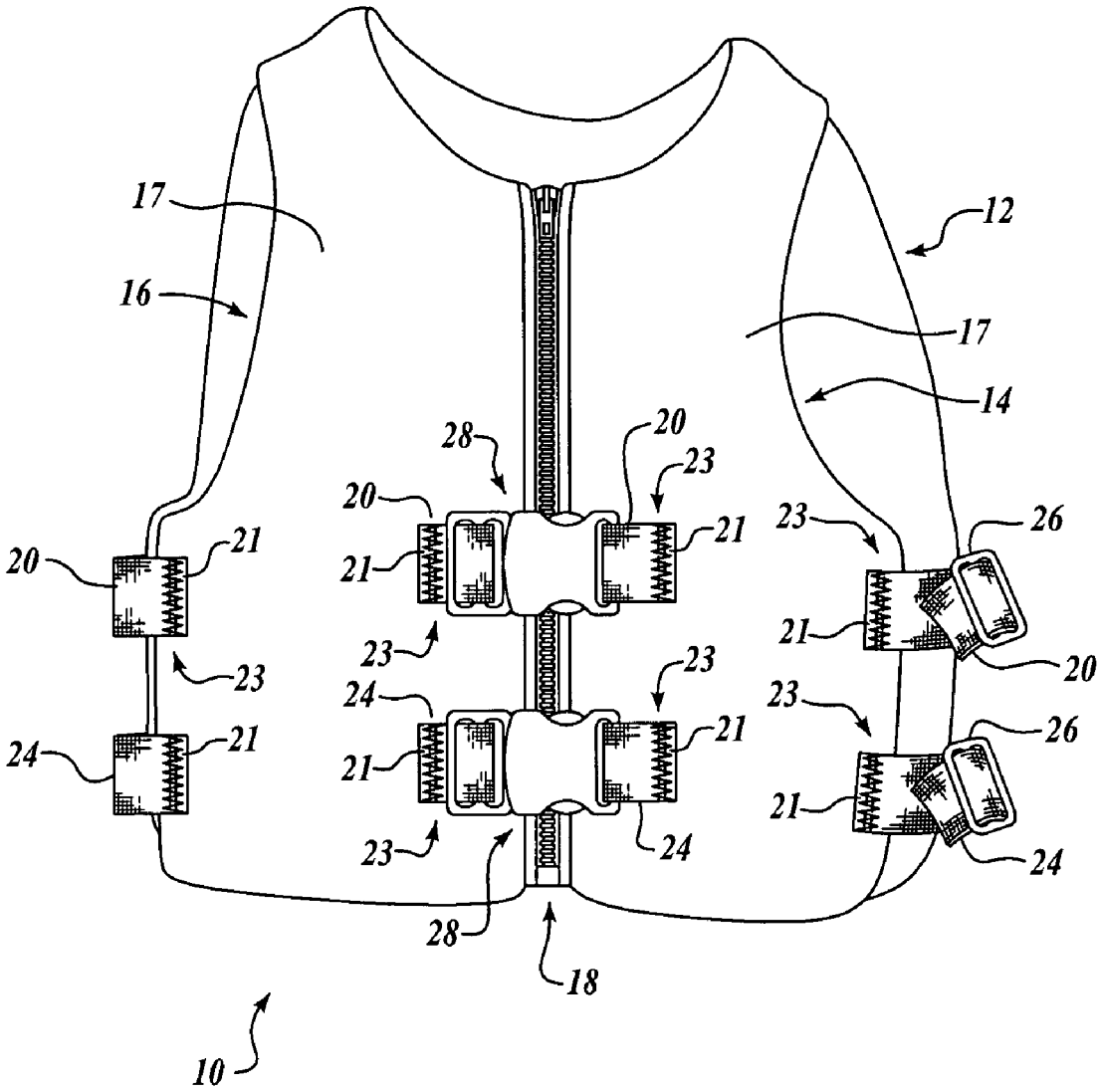
FIG. 1 is a front view of a personal floatation vest incorporating the present invention.

Turning to FIG. 1, an exemplary personal floatation vest 10 in accordance with an embodiment of the present invention is shown. The vest 10 includes a back segment 12 incorporating a buoyant material (not shown), a front left segment 14 incorporating a buoyant material (not shown), and a front right segment 16 also incorporating a buoyant material (not shown). The back segment 12, the front left segment 14, and the front right segment 16 are attached together to form a vest shape with the left front segment 14 connected to the back segment 12 over the user's left shoulder (not shown) above a left arm opening 2, and also connected to the back segment 12 below the arm opening 2, on the left side 7 of the vest 10. the right front segment 16 similarly is joined over the right shoulder of the user (not shown) above a right arm opening 3 to the back segment 12, and is also joined to the back segment 12 under the right arm opening 3 on the right side 6 of the vest 10. The left front segment 14 and the right front segment 16, in this example embodiment, are detachably connected with a zipper 18 in the front center 8 of the vest 10. The back segment 12 joined with the left front segment 14 and the right front segment 16 also form a neck opening 4 in the vest 10.

The vest 10 suitably includes two body-encircling body straps 20 and 24. The body straps 20 and 24, by way of example are suitably constructed of nylon webbing or similar material. Each strap 20 and 24 includes a buckle 28 permitting opposite ends of the straps 20 and 24 to be joined at the front center 8 of the vest 10, in this embodiment outside and across the zipper 18. The body straps 20 and 24 each also include at least one adjustment device 26 permitting the body straps 20 and 24 to be lengthened or shortened. In this embodiment the adjusting device 26 is suitably a figure-eight-shaped retainer and the adjustment device comprised of either metal or plastic conformed for holding and adjusting flat webbing.

In the embodiment shown in FIG. 1, the floatation material of the vest 10 is covered by a cover 17 covering buoyant material (not shown) with the back segment 12, the left front segment 14, and the right front segment 16. By way of example and not limitation, the cover may suitably be any covering material including neoprene or stretchable fabric. The cover 17 may suitably cover all or part of the buoyant material (not shown) that provides the floatation within the back segment 12, the left front segment 14 and the right front segment 16.

The two body straps 20 and 24 are also covered by the cover 17 over much of their length as they encircle the body of the user (not shown) within the vest 10. In this example embodiment, each strap 20 and 24 is between the cover 17 and the buoyant segments 12, 14, and 16 forming the vest 10. Near the lateral sides of the segments 12, 14, and 16, the straps 20 and 24 pass through the cover 17, from between the buoyant material (not shown) and the cover 17 to outside of the cover 17. Thus, by way of example, at the left side 7 of the left front segment 14 the straps 20 and 24 pass through the cover 17 through openings or pass-throughs 23 from outside the cover 17 to between the cover 17 and the buoyant material (not shown) inside the cover 17. Near the location where the straps 20 and 24 pass through the cover 17, the straps are stitched to the cover 17 with stitching 21. The straps 20 and 24 span the left front segment 14 under the cover 17 to near the center 8 of the vest 10 where the straps 20 and 24 then exit from under the cover 17 through openings or pass-throughs 23. The straps 20 and 24 are stitched to the cover 17 at or near the pass-throughs 23 with stitching 21. It will be appreciated that, by way of example, but not limitation, bar tacks, or multiple stitching across the width of the straps 20 and 24 suitably attaches the straps 20 and 24 to the cover 17 retaining the straps 20 and 24 in position in the left front segment 14 near the left side 7 and the center line 8 of the vest 10. Thus, between the pass-throughs 23 where the straps 20 and 24 pass underneath the cover 17 and then out again, the straps 20 and 24 are fully covered providing a smooth surface to the left front segment 14 of the vest 10, and also reducing opportunities for snagging.

Figure 4A:
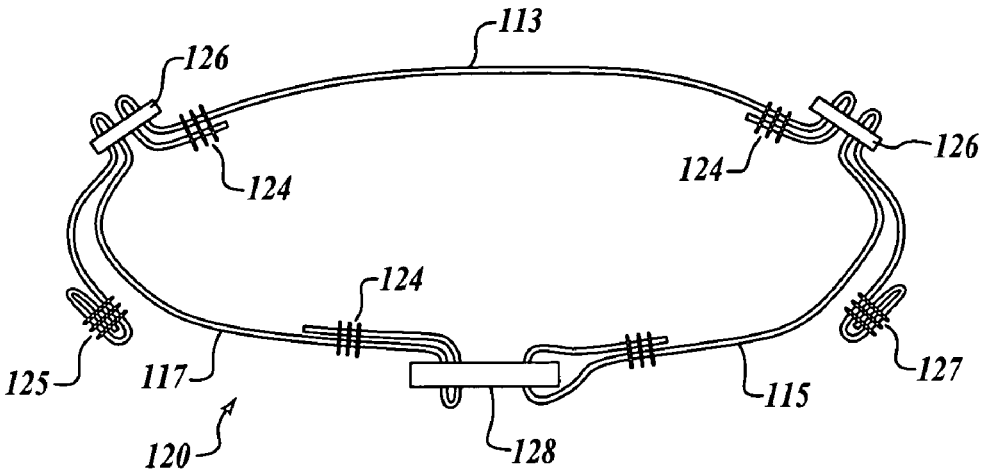
FIG. 4A is a top view of a body strap of the present invention.
Figure 4B:
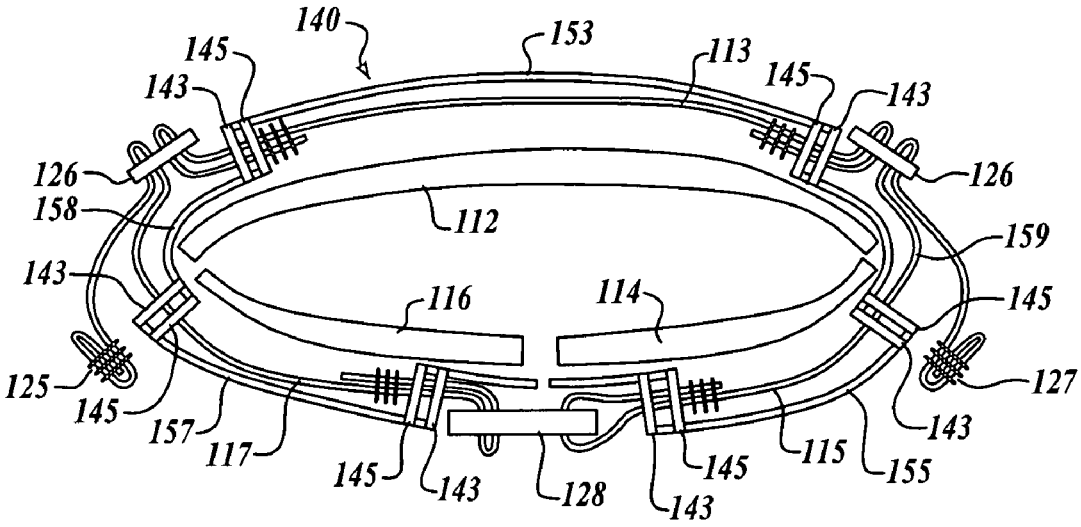
FIG. 4B is a top view cross-section of a personal floatation vest of the present invention.

Near the center line 8 of the vest 10, the straps 20 and 24 pass out from under the cover 17 of the left front section 14 and are then linked to buckles 28. When buckled, the buckles 28 buckle the straps 20 and 24 across the user's belly (not shown) over the zipper 18. The zipper 18 also detachably joins the left front segment 14 and the right front segment 16 of the vest 10. After passing across the zipper 18 at the center line 8 of the vest 10, the straps 20 and 24 pass-through the cover 17 of the vest 10 in the right front segment 16 of the vest 10. The straps 20 and 24 re-enter the cover 17 and are sandwiched between the cover 17 and the buoyant material (not shown) the right hand segment 16 approximate to the front center 8 of the vest 10. The straps 20 and 24 pass through the cover through openings or pass-throughs 23 in the cover 17. By way of example, and not limitation, the straps 20 and 24 are stitched to the cover with stitching 21 at or near the pass-throughs 23. This secures the straps 20 and 24 in place with respect to the cover 17. The straps 20 and 24 then span the right front segment 16 of the vest 10 under the cover 17 to the right side 6 of the vest 10. At the right side 6 of the right hand segment 16, the straps 20 and 24 exit from under the cover 17 through pass-throughs or openings 23. The straps 20 and 24 then pass across the right side of the user (not shown) to the back 12 of the vest 10 where the straps 20 and 24 are hidden in this view in FIG. 1. In this exemplary embodiment, as in the left front segment 14 and the right front segment 16, and as shown in FIG. 4B, the straps 20 and 24 pass through the cover 17 (not shown) of the back segment 12 between the cover 17 and the buoyant material (not shown) in the same manner as described for the left front segment 14 and the right front segment 16. The straps 20 and 24 thus pass through the cover 17 of the vest 10 near the right side 6 of the back segment 12, span the back segment 12 of the vest 10 underneath the cover 17 and over the buoyant material (not shown), and re-exit the cover 17 near the left side 7 of the back segment 12 of the vest 10. The straps 20 and 24 then come around the left side of the user (not shown) to connect with the left edge 7 of the left front segment 14 via the adjustment devices 26 described above. In this manner, the straps 20 and 24 are covered by the cover 17 of the vest 10 over much of their length as they encircle the body of the user (not shown). In this exemplary embodiment, the straps 20 and 24 are outside of the cover 17 only where they cross the zipper 18 at the front center line 8 of the vest 10, where they connect the back segment 12 with the left front segment 14 on the left side 7 of the vest 10, and where they connect the back segment 12 with the right front segment 16 on the right side 6 of the vest 10. In all other locations, in this exemplary embodiment, the straps 20 and 24 are underneath the cover 17 of the vest 10.

Figure 2:
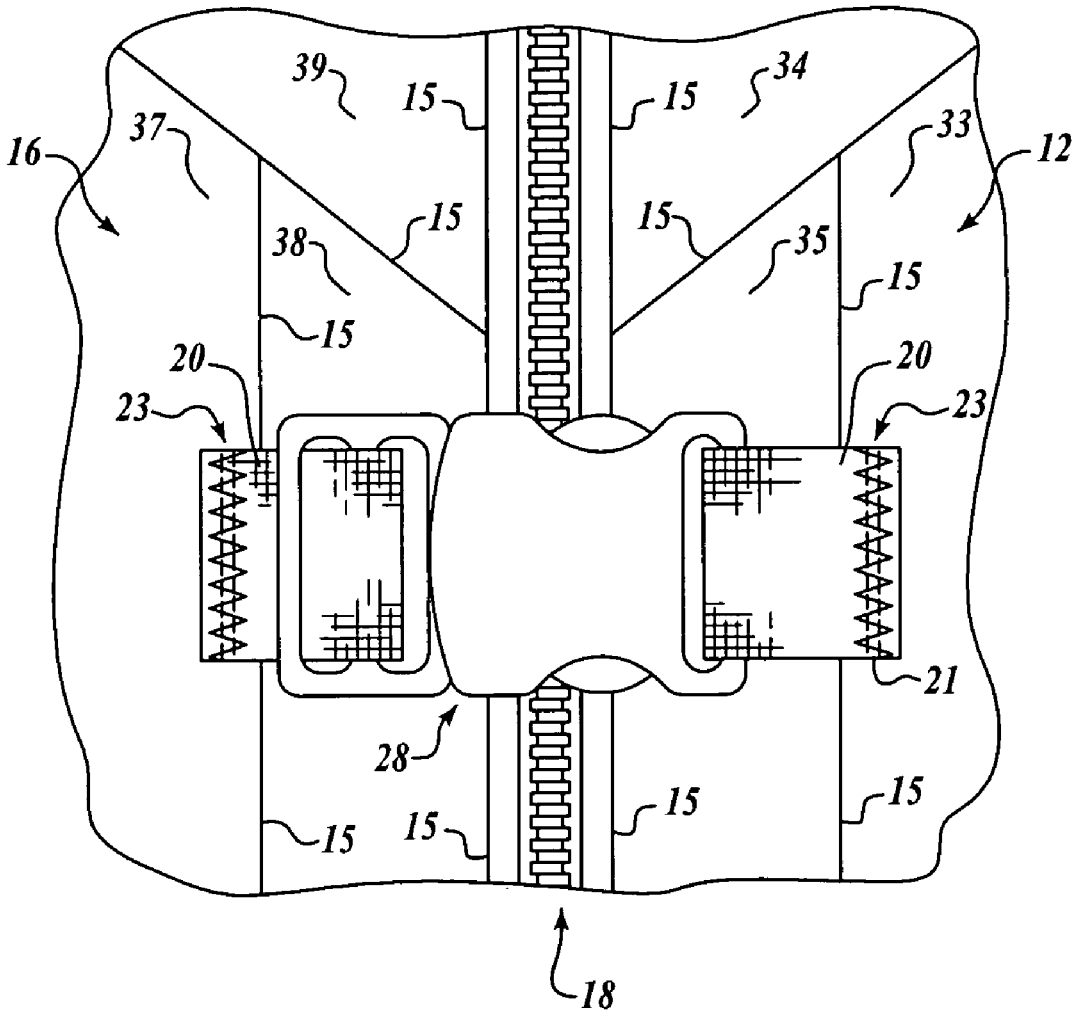
FIG. 2 is a close-up view of the front of the personal floatation vest of FIG. 1.

FIG. 2 is a close-up detail of the vest 10 of FIG. 1, showing exemplary construction details in an area of the front of the vest 10 near the front center 8 of the vest 10, where one of the straps 20 crosses the front zipper 18. As described above with reference to FIG. 1, a left front segment 14 of the vest 10 is joined to a right front segment 16 of the vest 10 with a zipper 18 at the front center 8 of the vest 10. The left front segment 14 and the right front segment 16 are covered with a fabric-like cover 17. In this embodiment the cover 17 for the left front segment 14 and the right front segment 16 are constructed from different portions of fabric sewn together with seams 15. The left front segment 14 includes three portions 33, 34 and 35 sewn together, with seams 15, and sewn to the zipper 18 with seams 15. In this exemplary embodiment, a first portion 34 forms an upper part of the cover 17, while a second portion 35 forms a vertical band next to the zipper 18, while a third portion 33 forms a vertical band away from the zipper 18. In this exemplary embodiment, the pass-through 23 where the strap 20 passes from within the cover 17 to outside the cover 17 from the user's left (towards the user's right) within the left front segment 14 is suitably a seam 15 between the second portion 35 and the third portion 33 of the cover 17 of the left front segment 14 of the vest 10. At the seam 15 between the second portion 35 and the third portion 33 the belt strap 20 passes from underneath the cover 17 to outside of the cover 17 so that it can pass outside of the zipper 18 at the center line 8 of the vest 10. At the seam 15 between the second fabric portion 35 and the third fabric portion 33 of the left front segment 14, there is additional stitching 21 where the strap 20 passes through to underneath the cover 17.

Similarly, the right front segment 16 of the vest 10 has a cover 17 that includes three fabric portions 37, 38, and 39. The fourth portion 37 forms an upper part of the cover 17 of the front right segment 16. Below the fourth portion 37 attached by seams 15 is the fifth portion 38 in a vertical band near the zipper 18, and the sixth portion 39 forming a vertical band sewn to the second portion 38 a distance away from the zipper 18. At the seam 15 joining the fifth portion 38 to the sixth portion 39 of the cover 17 of the right front segment 16, as with the left front segment 14, the strap 20 passes through the cover 17 at a pass-through 23. In this example, the pass-through 23 is located at a seam 15 between the fifth portion 38 and the sixth portion 39 of the cover 17 of the right hand segment 16. At the seam 15 joining the fifth portion 38 and the sixth portion 39 of the cover 17 there is additional stitching 21 stitching the strap 20 to the cover 17 where the strap 20 passes through the cover 17. It will be appreciated that a wide variety of configurations of stitching and fabric pieces may suitably be utilized to join the strap 20 to the cover 17 of the respective segments 14 and 16 of the vest 10.

Figure 3A:
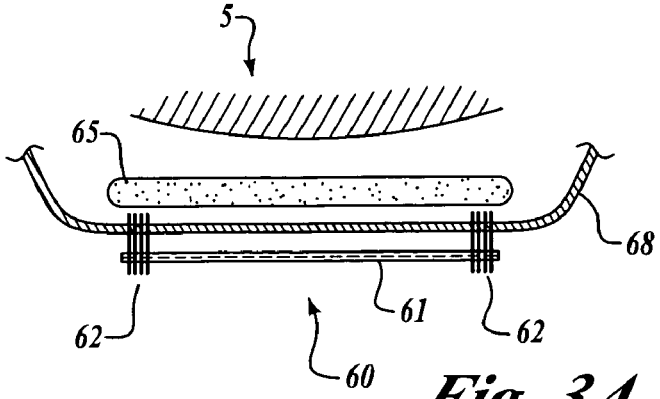
FIG. 3A is a top view cross-section of a buoyant segment of the present invention.
Figure 3B:
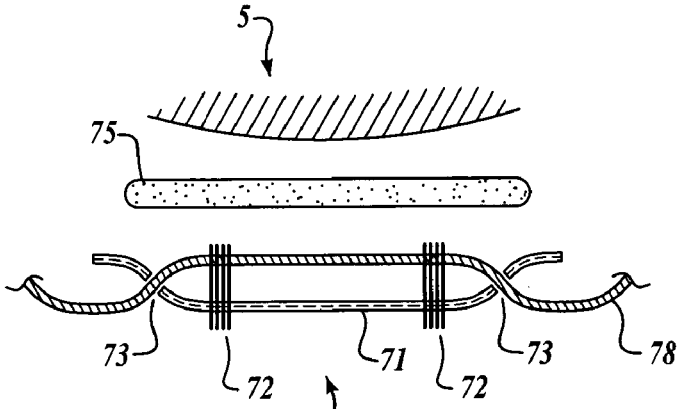
FIG. 3B is a top cross-section of an alternate buoyant segment of the present invention.
Figure 3C:
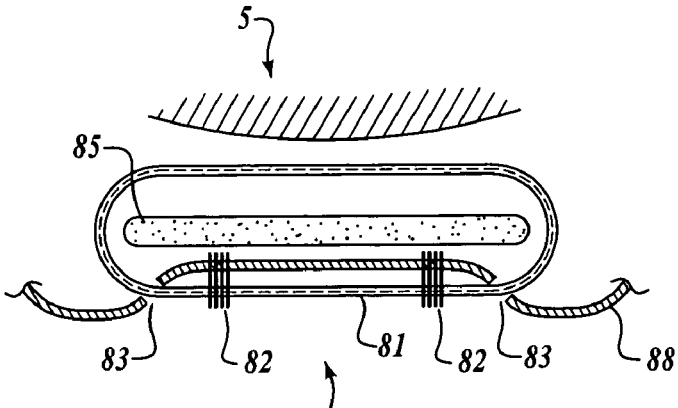
FIG. 3C is a top view of a second alternate buoyant segment of the present invention.

FIGS. 3A, 3B, and 3C are top view cross-sections of buoyant segments of personal floatation devices incorporating the present invention. In each of the three figures the buoyant segment is shown against the body 5 of a user.

In FIG. 3A a belt 68 is sandwiched between a cover 61 and buoyant material 65. In this exemplary embodiment, the cover 61 and the buoyant material 65 have lateral edges 66 and 67 that are aligned with each other. The belt 68 extends past the lateral edges 66 and 67 of the cover 61 and the buoyant material 65. At the lateral edges 66 and 67 of the cover 61, the belt 68 stitched to the cover 61 with stitching 62. In the example as shown, the stitching 62 comprises multiple cross-stitches located at the lateral edges 66 and 67 of the cover 61, without further stitching between the belt 68 and the cover 61. The resulting buoyant segment 60, thus, includes the cover 61 covering the buoyant material 65, and the belt 68 projecting from the lateral edges 66 and 67 of the cover 61 and buoyant material 65. In this example, the cover 61 covers only the side of the buoyant material 65 away from the body of the user 5.

In FIG. 3B, an exemplary buoyant segment 70 is shown proximate to the body of the user 5. A belt 78 is sandwiched between a cover 71 and buoyant material 75. In contrast to FIG. 3A, the belt 78 of the buoyant segment 70 exits from between the cover 71 and the buoyant material 75 near the lateral edges 76 and 77 of the buoyant segment 70. The belt passes through the cover 71 at pass-throughs 73 near but not at the lateral edges 76 and 77 of the cover 71, which in this embodiment are also near the lateral edges 76 and 77 of the buoyant material 75. Thus, near the lateral edges 76 and 77 of the cover 71 and the buoyant material 75, the belt 78 is outside of the cover 71 while in the center section 79 of the cover 71 the belt 78 is between the cover and the buoyant material 75.

In this exemplary embodiment the belt 78 is stitched to the cover with stitching 72. The stitching 72 comprises multiple cross-stitches near the pass-throughs 73 which in turn are near the lateral edges 76 and 77 of the cover 71. The belt 78 passes through the cover 71 at the pass-through 73 and then is stitched to the cover 71 near a pass-through 73 where the belt 78 is inside the cover 71. As noted above the stitching 72 suitably may include bar tacks stitching the belt 78 to the webbing cover 17.

In FIG. 3C the example buoyant segment 80 includes a cover 81 that surrounds the buoyant material 85, including the side of the buoyant material 85 facing the user 5. In this exemplary embodiment a belt 88 is sandwiched between the cover 81 and the buoyant material 85 across the center 89 of the cover 81 and the buoyant material 85, on the side of the buoyant material 85 away from the user 5. The belt 88 passes from outside to underneath the cover 81 and thus to between the cover 81 and the buoyant material 85 near the lateral edges 86 and 87 of the buoyant material 85 through pass-throughs 83. The belt 88 passes through the pass-through 83 and then is stitched to the cover 81 near the pass-throughs 83 where the belt is inside the cover 81, between the cover 81 and the buoyant material 85. The belt 88 is then underneath the cover 81 across the center 89 of the cover 81 on the side away from the user, and then passes to the outside of the cover 81 near the opposite lateral edge 87 of the buoyant material 85 again through a pass-through 83. Just prior to exiting the cover 81 through the pass-through 83, the belt 88 is stitched to the cover 81. As described above, the belt 88 is stitched to the cover 81 with stitching 82 which suitably may include bar tacks, or multiple cross-stitching across the belt 88. It will be appreciated that the buoyant material 85 suitably may have an additional inner cover or layer (not shown) within the cover 81, such as, by way of example, a vinyl or plastic layer applied to the buoyant material FIGS. 4A and 4B show further details of a body-encircling belt 120 and a personal floatation device 140 incorporating multiple buoyant segments of the present invention. FIGS. 4A and 4B are top views of the belt 120, and the personal floatation device 140 with the belt 120, respectively. No user is shown. In FIG. 4A the body-encircling belt 120 includes three sections, a back section 113, a left front section 115, and a right front section 117. The back section 113 is linked to the left front section 115 and the right front section 117 with plastic slide adjustments 126. In this exemplary embodiment the slide adjustments 126 are positioned at the sides of the back of the user (not shown). The back segment 113 at both ends passes through and into the slide adjustment 126, returning back onto itself at each slide adjustment location to be stitched down with stitching 124. This places a slider unit 126 at both sides of the back of the user. The left front section 115 of the belt 120 and the right front section 117 of the belt 120 are also threaded through their respective slider sections 126, adjustably joining them with the back section 113. These connections are adjustable, permitting the belt 120 to be adjusted in length from either or both sides. The end of the left front section 115 linked to the back section 113 is threaded through the slide adjustment 126, and is terminated in a left folded-over section 127 of the belt 120. The left folded section 127 that is stitched with stitching 124 which prevents the belt 120 from becoming unthreaded from the slide adjustment 126. Similarly, on the right side, the end of the right front segment 117 of the belt 120 linked to the back segment 113, adjustably passes through a slide adjustment 126 and is terminated with a right hand folded-over section 125 of the belt 120. At the front 121 of the belt 120, both the left front segment 115 and the right front segment 117 pass through two parts of a webbing snap buckle 128 and are stitched to themselves with stitching 124, attaching them to the front center buckle 128. The buckle 128 allows the body-encircling belt 120 to be opened by the user (not shown), but in this embodiment incorporates no length adjustment at the front center 121 of the user. Waist and chest size adjustments are made by adjusting the slide adjustments 126 at the user's sides. Stitching the left front section 115 and the right front segment 117 of the belt 120 to the buckle 128 and having the adjustable sliders 126 near the sides of the back section 113 of the belt 120 suitably leaves the front 121 of the belt free of any loose tabs or connections that might get in the way of the user (not shown).

The belt 120 of FIG. 4A is incorporated in the personal floatation device 140 of FIG. 4B with the same components as described in connection with FIG. 4A. The belt 120 and a cover 150 surround three buoyant segments forming the personal floatation device 140 in this example a vest. The three buoyant segments include a front left segment 114, a front right segment 116, and a back segment 112. The buoyant segments 114, 116, and 122 encompass over most of the circumference of the personal floatation device 140. The belt 120 of FIG. 4A is sandwiched between the cover 150 and the front left, front right, and back segments, 114, 116, and 112 respectively, of the buoyant material. The belt 120 exits from the cover 150 for comparatively short distances at the left 161 and the right 163 sides of the device 140, and at the front center 167 of the device 140. At the left side 161 and the right side 163 of the device 140, the two adjustable sliders 126 of the belt 120 are outside of the cover, permitting the belt 120 to be adjusted in length by the user.

The cover 150, in this example embodiment, is constructed in seven pieces completely covering the outside of the personal floatation device 140, outside of the three buoyant segments 114, 116, and 112. Starting at the front center 167 of the personal floatation device 140 and proceeding circumferentially around to the right, the first cover piece is the right center piece 171 attached to the zipper 172 located at the front center 167 of the personal floatation device 140. The right center piece 171 is attached to the right front piece 157 a short distance to the right from the zipper 172. At the location where the right center piece 171 is attached to the right front piece 157 there is a pass-through 143 permitting the belt 120 to pass from outside of the personal floatation device 140 at the front center 167 of the personal floatation device 140 to under the cover 150, in this instance under the right front piece 157 of the cover 150. Proximate to the pass-through 143, the belt 120 is stitched to the cover with stitching 145. The stitching 145 suitably may include a bar tack, or may include a seam holding the right center piece 171 and the right front piece 157 of the cover 150 together. Continuing to the right at the right side 163 of the personal floatation device 140, the right front piece 157 is attached to a right side piece 158. The right side piece 158 is a short width of fabric located at the right side of the user (not shown) at or near the connection between the right front piece 157 and the right side 158 pieces of the cover 150, the belt 120 exits from under the cover 150. Thus the belt 120 is at the outside of the personal floatation device 140 over the cover 150 for a short distance at the right side of the user. At this location, as described above in connection with FIG. 4A, there is an adjustable slider 126 permitting the length of the belt 120 to be adjusted at the right side of the user (not shown). The belt 120 passes outside of the cover at or near the junction of the right front piece 157 and the right side piece 158 of the cover 150 through a pass-through 143. The belt 120 is stitched to the cover 150 near the pass-through 143, again suitably utilizing a bar tack, or stitching between the right front piece 157 and the right side piece 158 of the cover 150.

Continuing around the right side 163 of the personal floatation device 140, the right side piece 158 is attached to the back piece 153 of the cover 150. At this location, the belt 120 again passes to underneath the cover 150. It will be appreciated as described in connection with FIGS. 3A, 3B, and 3C, that when the belt 120 is underneath the cover 150 it is sandwiched between the cover 150 and the corresponding buoyant material within the cover 150. Thus, here, the belt 120 passes across the back of the user (not shown) underneath the back piece 153 of the cover 150 and outside of the back segment 112 of the buoyant material providing floatation for the personal floatation device 140. Proximate to where the right side piece 158 is attached to the back piece 153 of the cover 150, near the right side 163 of the device 140. The belt 120 passes through the cover 150 at a pass-through 143. The belt 120 is stitched to the cover 150 with stitching 145 proximate to the pass-through 143, in the manner described above.

After crossing the back of the user (not shown) the belt 120 exits from under the cover 150 near the left side 161 of the personal floatation device 140. The back piece 153 is linked to a left side piece 159 of the cover 150, near the left side 161 of the personal floatation device 140. The belt 120 exits from under the cover 150 in this example embodiment proximate to the location of where the back piece 153 and the left side piece 159 are attached to each other. The belt 120 passes to outside the cover through another pass-through 143, and is stitched to the cover with stitching 145 near the pass-through 143. After exiting from under the cover 150, the belt 120 has another slide adjustment 126, at the left side 161 of the personal floatation device 140. The user (not shown) can thus adjust the length of the belt 120 from the left side 161, as well as from the right side 163 of the personal floatation device 140. The left side piece 159 of the cover 150, as with the right side piece 158 of the cover 150, is relatively narrow in width, in this embodiment, spanning only a few inches of the left side 161 of the personal floatation device 140 at the left side of the user (not shown).

Continuing around the personal floatation device 140, the left side piece 159 is attached to a front left piece 155 of the cover 150 near the left side 161 of the personal floatation device 140. Near or at the attachment of the left side piece 159 and the front left piece 155 of the cover 150, the belt 120 again passes to underneath the cover 150 through a pass-through 143. This pass-through 143 is near the left side 161 of the personal floatation device 140. As with the other pass-throughs 143, the belt 120 is stitched to the cover 150 proximate to the pass-through 143. The belt then spans the left front of the user (not shown) under the left front piece 155 of the cover 150 and over the left front segment 114 of buoyant material to near the front center 167 of the personal floatation device 140. At that location the belt 120 exits from under the cover 150 to be joined to the buckle 128 at the front center 167 of the personal floatation device 140. This completes the loop of the belt 120 around the body of the user (not shown) and the personal floatation device 140.

The left front piece 155 of the cover spans from near the left side 161 of the personal floatation device 140 to near the front center 167 of the personal floatation device 140 where the left front piece 155 is attached to a left center piece 173. The left center piece 173 of the cover 150 which in turn then is attached to the zipper 172 at the front center 167 of the personal floatation device 140, completing the loop of the cover 150 around the body of the user (not shown) and the buoyant material segments 112, 114, and 116. Near where the front left piece 155 is attached to the left center piece 173 of the cover 150 is another pass-through 143. As described above, the belt 120 exits from under the cover 150 at the pass-through 143, where it is attached to the buckle 128 at the front center 167 of the personal floatation device 140. At or near the pass-through 143 the belt 120 is stitched to the cover with stitching 145, in the manner described in reference to the other pass-throughs 143.

In summary, the example personal floatation device 140 of FIG. 4B includes three segments of buoyant material, a front left segment 114, a front right segment 116, and a back segment 112, surrounding the user (not shown). The buoyant material segments 112, 114, and 116 are covered on their sides away from the user by a cover 150. Just underneath the cover 150, for most of the circumference of the user (not shown), is the belt 120 which exits from between the cover 150 and the respective buoyant material segments 112, 114, and 116 for a comparatively short distance at the front center 167 of the personal floatation device 140 where the belt 120 is buckled with a buckle 128, and on the left side 161 and the right side 163 where the belt 120 has adjusting sliders 126. Other than in these three areas, the front center 167, the left side 161 and the right side 163 of the personal floatation device 140, the belt is underneath the cover 150, forming a smooth surface without loops or elements that can be snagged. The areas where the belt 120 is under the cover 150 are also smooth, and may have logos or other color patterns installed uninterrupted by the belt 120, which is advantageous for aesthetic reasons.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A system for a covered belt for a personal flotation device, the system comprising:

a buoyant material, having a first side arranged to face towards a body of a user of the device, and a second side arranged to face away from the body;

a cover, arranged to cover at least a portion of the second side of the buoyant material; and a belt, arranged to encircle a portion of the body, positioned between at least a portion of the cover and the second side of the buoyant material, the belt passing through the cover at at least one location, the belt being stitched to the cover adjacent the at least one location where the belt passes through the cover.

2. The system of claim 1, wherein the cover includes stretchable fabric.

3. The system of claim 2, wherein the stretchable fabric includes neoprene.

4. The system of claim 1, wherein the belt includes nylon webbing.

5. The system of claim 1, wherein the belt is arranged to encircle the body.

6. The system of claim 1, wherein the belt is stitched to the cover at at least two locations.

7. The system of claim 6, wherein the cover includes a first lateral edge, and a second lateral edge, and the belt is stitched to the cover near the first lateral edge and the second lateral edge.

8. The system of claim 1, wherein the belt passes through the cover at at least one location.

9. The system of claim 8 wherein the belt being stitched to the cover near the at least one location where the belt passes through the cover includes being stitched with a bar tack.

10. The system of claim 8 wherein the belt passes through the cover at at least two locations.

11. The system of claim 10 wherein the belt is stitched to the cover near the at least two locations where the belt passes through the cover.

12. The system of claim 11 wherein the belt is stitched to the cover near the at least two locations where the belt passes through the cover includes being stitched with a bar tack.

13. The system of claim 1 wherein the belt being stitched to the cover at at least one location includes being stitched with a bar tack.

14. A personal flotation device, the device comprising:

at least one segment of buoyant material, having a first side arranged to face towards a body of a user of the device, and a second side arranged to face away from the body;

at least one cover, arranged to cover at least a portion of the second side of the segment of buoyant material; and a belt, arranged to encircle the body, positioned between at least a portion of the cover and the second side of the buoyant material, the belt passing through the cover from inside to outside at at least one location, the belt stitched to the cover approximately adjacent the at least one location where the belt passes through the cover.

15. The system of claim 14, wherein the cover includes stretchable fabric.

16. The system of claim 15, wherein the stretchable fabric includes neoprene.

17. The system of claim 14, wherein the belt includes nylon webbing.

18. The system of claim 14, wherein the belt is stitched to the cover at at least two locations.

19. The system of claim 18, wherein the cover includes a first lateral edge, and a second lateral edge, and the belt is stitched to the cover near the first lateral edge and the second lateral edge.

20. The system of claim 14, wherein the belt passes through the cover at at least one location.

21. The system of claim 20 wherein the belt passes through the cover at at least two locations.

22. The system of claim 21 wherein the belt is stitched to the cover near the at least one location where the belt passes through the cover.

23. The system of claim 22 wherein the belt is stitched to the cover near the at least two locations where the belt passes through the cover.

24. The system of claim 22 wherein the belt is stitched to the cover includes being stitched with a bar tack.

25. A system for a covered belt for a personal flotation device, the system comprising:

a buoyant material, having a first side arranged to face towards a body of a user of the device, a second side arranged to face away from the body, and a first lateral edge, and a second lateral edge;

a stretchable cover, arranged to cover the second side of the buoyant material, having an inside facing towards the buoyant material and an outside facing away from the buoyant material; and a belt, arranged to encircle a portion of the body, positioned between at least a portion of inside of the cover and the second side of the buoyant material, the belt passing from the inside to the outside through the cover at a first location adjacent the first lateral edge and from the inside to the outside at a second location adjacent the second lateral edge, and the belt stitched to the cover adjacent the first location and adjacent the second location.

26. The system of claim 25, wherein the stretchable fabric includes neoprene.

27. The system of claim 25, wherein the belt includes nylon webbing.

28. A personal flotation device, the device comprising:

a back segment of buoyant material, having a first side arranged to face towards a body of a user of the device, and a second side arranged to face away from the body, and having a first right lateral edge and a first left lateral edge, a right front segment of buoyant material, having a third side arranged to face towards a body of a user of the device, a fourth side arranged to face away from the body, a second right lateral edge and a second left lateral edge, the right front segment attached to the back segment near the first right lateral edge and the second right lateral edge;

a left front segment of buoyant material, having a fifth side arranged to face towards a body of a user of the device, and a sixth side arranged to face away from the body, a third right lateral edge and third left lateral edge, the left front segment attached to the back segment near the first left lateral edge and the third left lateral edge, the left front segment arranged to be detachably linked to the right front segment near the second left lateral edge and the third right lateral edge;

a back cover of stretchable fabric arranged to cover at least a portion of the second side;

a right front cover of stretchable fabric arranged to cover at least a portion of the fourth side;

a left front cover of stretchable fabric arranged to cover at least a portion of the sixth side;

at least one belt, arranged to encircle the body, sandwiched between at least a portion of the back cover and the back segment, sandwiched between at least a portion of the right front cover and the right front segment, and sandwiched between at least a portion of the left front cover and the left front segment, the at least one belt stitched at at least one location to the back cover, stitched at at least one location to the right front cover, and stitched at at least one location to the left front cover, wherein the belt passes through the cover at at least one location and is stitched to the cover near where it passes through.

29. The system of claim 28, wherein the stretchable fabric includes neoprene.

30. The system of claim 28 wherein the belt includes nylon webbing.

31. The system of claim 28 wherein the belt is stitched to the back cover at at least two locations.

32. The system of claim 31, wherein the back cover includes a first right edge, and a first left edge, and the belt is stitched to the cover near the first right edge and the first left edge.

33. A personal flotation device, the device comprising:

a back segment of buoyant material, having a first side arranged to face towards a body of a user of the device, and a second side arranged to face away from the body, and having a first right lateral edge and a first left lateral edge, a right front segment of buoyant material, having a third side arranged to face towards a body of a user of the device, a fourth side arranged to face away from the body, a second right lateral edge and a second left lateral edge, the right front segment attached to the back segment near the first right lateral edge and the second right lateral edge;

a left front segment of buoyant material, having a fifth side arranged to face towards a body of a user of the device, and a sixth side arranged to face away from the body, a third right lateral edge and third left lateral edge, the left front segment attached to the back segment near the first left lateral edge and the third left lateral edge, the left front segment arranged to be detachably linked to the right front segment near the second left lateral edge and the third right lateral edge;

a back cover of stretchable fabric arranged to cover at least a portion of the second side;

a right front cover of stretchable fabric arranged to cover at least a portion of the fourth side;

a left front cover of stretchable fabric arranged to cover at least a portion of the sixth side;

at least one belt, arranged to encircle the body, sandwiched between at least a portion of the back cover and the back segment, sandwiched between at least a portion of the right front cover and the right front segment, and sandwiched between at least a portion of the left front cover and the left front segment, the at least one belt stitched at at least one location to the back cover, stitched at at least one location to the right front cover, and stitched at at least one location to the left front cover, wherein the belt passes through the back cover at at least two locations.

34. The system of claim 33 wherein the belt is stitched to the back cover near the at least two locations where the belt passes through the back cover.

35. The system of claim 28, wherein the belt is stitched to the right front cover at at least two locations.

36. The system of claim 35, wherein the right front cover includes a first right edge, and a first left edge, and the belt is stitched to the cover near the first right edge and the first left edge.

37. A personal flotation device, the device comprising:

a back segment of buoyant material, having a first side arranged to face towards a body of a user of the device, and a second side arranged to face away from the body, and having a first right lateral edge and a first left lateral edge, a right front segment of buoyant material, having a third side arranged to face towards a body of a user of the device, a fourth side arranged to face away from the body, a second right lateral edge and a second left lateral edge, the right front segment attached to the back segment near the first right lateral edge and the second right lateral edge;

a left front segment of buoyant material, having a fifth side arranged to face towards a body of a user of the device, and a sixth side arranged to face away from the body, a third right lateral edge and third left lateral edge, the left front segment attached to the back segment near the first left lateral edge and the third left lateral edge, the left front segment arranged to be detachably linked to the right front segment near the second left lateral edge and the third right lateral edge;

a back cover of stretchable fabric arranged to cover at least a portion of the second side;

a right front cover of stretchable fabric arranged to cover at least a portion of the fourth side;

a left front cover of stretchable fabric arranged to cover at least a portion of the sixth side;

at least one belt, arranged to encircle the body, sandwiched between at least a portion of the back cover and the back segment, sandwiched between at least a portion of the right front cover and the right front segment, and sandwiched between at least a portion of the left front cover and the left front segment, the at least one belt stitched at at least one location to the back cover, stitched at at least one location to the right front cover, and stitched at at least one location to the left front cover, wherein the belt passes through the right front cover at at least two locations.

38. The system of claim 32 wherein the belt is stitched to the right front cover near the at least two locations where the belt passes through the right front cover.

39. The system of claim 28, wherein the belt is stitched to the left front cover at at least two locations.

40. The system of claim 35, wherein the left front cover includes a first right edge, and a first left edge, and the belt is stitched to the cover near the first right edge and the first left edge.

41. A personal flotation device, the device comprising:

a back segment of buoyant material, having a first side arranged to face towards a body of a user of the device, and a second side arranged to face away from the body, and having a first right lateral edge and a first left lateral edge, a right front segment of buoyant material, having a third side arranged to face towards a body of a user of the device, a fourth side arranged to face away from the body, a second right lateral edge and a second left lateral edge, the right front segment attached to the back segment near the first right lateral edge and the second right lateral edge;

a left front segment of buoyant material, having a fifth side arranged to face towards a body of a user of the device, and a sixth side arranged to face away from the body, a third right lateral edge and third left lateral edge, the left front segment attached to the back segment near the first left lateral edge and the third left lateral edge, the left front segment arranged to be detachably linked to the right front segment near the second left lateral edge and the third right lateral edge;

a back cover of stretchable fabric arranged to cover at least a portion of the second side;

a right front cover of stretchable fabric arranged to cover at least a portion of the fourth side;

a left front cover of stretchable fabric arranged to cover at least a portion of the sixth side;

at least one belt, arranged to encircle the body, sandwiched between at least a portion of the back cover and the back segment, sandwiched between at least a portion of the right front cover and the right front segment, and sandwiched between at least a portion of the left front cover and the left front segment, the at least one belt stitched at at least one location to the back cover, stitched at at least one location to the right front cover, and stitched at at least one location to the left front cover wherein the belt passes through the left front cover at at least two locations.

42. The system of claim 41 wherein the belt is stitched to the left front cover near the at least two locations where the belt passes through the left front cover.

43. A method for covering a belt on a personal floatation device, comprising:

arranging a cover over a buoyant material sandwiching at least a portion of a belt between a portion of the cover and the buoyant material;

passing the belt through the cover at at least one location; and stitching the belt to the cover adjacent the at least one location that it passes through the cover.

44. The method of claim 43 wherein arranging the cover over the buoyant material includes stretching the cover over the buoyant material.

45. The method of claim 43, further comprising passing the belt through the cover at at least one penetration.

46. A personal flotation device, the device comprising:

a plurality of segments of buoyant material, each segment having a first side arranged to face towards a body of a user of the device, and a second side arranged to face away from the body, and each segment having a right lateral edge and a left lateral edge, a cover of stretchable fabric arranged to cover the first side of the plurality of segments of buoyant material; and at least one belt, arranged to encircle the body, and arranged to pass though the cover at a plurality of locations, the at least one belt being stitched to the cover adjacent the locations that it passes through the cover.

47. The system of claim 46 wherein the at least one belt is stitched to the cover near the plurality of locations where the at least one belt passes through the cover.

48. The system of claim 47, wherein the at least one belt is stitched to the cover near the right lateral edge and the left lateral edge of at least one segment of buoyant material.

49. The system of claim 46, wherein the at least one belt passes through the cover near the right lateral edge and the left lateral edge of at least one segment of buoyant material.

* * * * *